US008656872B1

(12) United States Patent
Dike

(10) Patent No.: US 8,656,872 B1
(45) Date of Patent: Feb. 25, 2014

(54) VARIABLE LIFT HYDRAULIC VALVE TRAIN

(76) Inventor: Anthony Dike, Ben Wheeler, TX (US)

( * ) Notice: Subject to any disclaimer, the term of this patent is extended or adjusted under 35 U.S.C. 154(b) by 281 days.

(21) Appl. No.: 13/230,372

(22) Filed: Sep. 12, 2011

(51) Int. Cl.
*F01L 9/02* (2006.01)

(52) U.S. Cl.
USPC ..... 123/90.12; 123/90.13; 123/90.16

(58) Field of Classification Search
USPC ..... 123/90.12, 90.13, 90.16
See application file for complete search history.

(56) References Cited

U.S. PATENT DOCUMENTS 4,655,178 A * 4/1987 Meneely ..... 123/321

* cited by examiner

*Primary Examiner* — Ching Chang
(74) *Attorney, Agent, or Firm* — Kyle Fletcher

(57) ABSTRACT

The variable lift hydraulic valve train works in conjunction with a master piston to provide a variable lift of a hydraulically operated valve by adjusting the hydraulic pressure created by the master piston. The variable lift hydraulic valve train includes a housing containing a variable camshaft, and stroke limiter piston. The stroke limiter piston is in fluid communication with the hydraulic fluid, which is in fluid communication with the master piston and valve piston. The position of the stroke limiter piston can be adjusted irrespective of engine RPM to provide varying lift and timing of the valve.

13 Claims, 8 Drawing Sheets

VARIABLE LIFT HYDRAULIC VALVE TRAIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of internal combustion engines, more specifically, a hydraulic valve train that features a variable lift and timing.

B. Discussion of the Prior Art

As a preliminary note, it should be stated that there is an ample amount of prior art that deals with internal combustion engines and valve trains. As will be discussed immediately below, no prior art discloses a hydraulic valve train that features, in addition to a master piston-pushrod-tappet-camshaft, a stroke limiter piston and variable camshaft that can adjust independent of the rpm and of which effectively varies the lift and timing of the valve by working in concert with the hydraulic pressure created adjacent said master piston.

The Decuir, Jr. Patent (U.S. Pat. No. 7,077,088) discloses an adjustable hydraulic cam and valve lift system for an internal combustion engine. However, the valve lift system is mechanically operated via a single overhead cam and does not include a hydraulically operated valve that is operated via a master piston; wherein a stroke limiter piston can adjust the hydraulic pressure to vary the lift of the valve irrespective of engine rpm.

The Kobayashi et al. Patent (U.S. Pat. No. 6,619,251) discloses a tappet for an internal combustion engine having a recess for storing lubricating oil beneath the camshaft lobe. However, the tappet and recess do not work in concert with a hydraulically operated valve and of which includes a variable lift mechanism involving a second camshaft and stroke limiter piston that can adjust the hydraulic pressure created by a master piston in order to provide a varying lift of a valve independent of engine RPM.

The Kawasaki et al. Patent (U.S. Pat. No. 5,572,963) discloses a hydraulic valve tappet having an oil reservoir. However, the hydraulic valve tappet is not a variable hydraulic valve train that can adjust the lift of the hydraulically operated valve.

The Camosso et al. Patent (U.S. Pat. No. 4,640,238) discloses an oil-tight hydraulic tappet for controlling an internal combsution engine valve. Again, the tappet is directed to controlling the valve, but does not adjust the hydraulic pressure produced by a master piston in order to vary the lift of a hydraulically operated valve independent of engine rpm.

The Barnard Patent (U.S. Pat. No. 5,857,438) discloses a hydraulically operated variable valve lift mechanism. However, the mechanism does not include, in addition to the tappet, pushrod, and master piston, a second variable camshaft and stroke limiter piston that can adjust the hydraulic pressure applied onto the valve independent of the engine rpm and master piston position.

The Skelley Patent (U.S. Pat. No. 4,502,426) discloses a variable lift and timing mechanism for an internal combustion engine. Again, the variable lift and timing mechanism does not integrate a second variable camshaft and stroke limiter piston that operate independent of an engine rpm to adjust the hydraulic pressure output onto a valve, and thus vary valve lift.

The Kosuda et al. Patent (U.S. Pat. No. 4,408,580) discloses a hydraulic valve lift device for an internal combustion engine that includes a lifter having an oil pressure chamber for the introduction of oil into the lifter bore mechanism. Again, the device does not integrate a second variable camshaft and stroke limiter piston that operates independent of an engine rpm to adjust the hydraulic pressure output onto a valve thereby adjusting valve lift.

While the above-described devices fulfill their respective and particular objects and requirements, they do not describe a hydraulic valve train that features, in addition to a master piston-pushrod-tappet-camshaft, a stroke limiter piston and variable camshaft that can adjust independent of the rpm and of which effectively varies the lift and timing of the valve by working in concert with the hydraulic pressure created adjacent said master piston. In this regard, the variable lift hydraulic valve train departs from the conventional concepts and designs of the prior art.

SUMMARY OF THE INVENTION

The variable lift hydraulic valve train works in conjunction with a master piston to provide a variable lift of a hydraulically operated valve by adjusting the hydraulic pressure created by the master piston. The variable lift hydraulic valve train includes a housing containing a variable camshaft, and stroke limiter piston. The stroke limiter piston is in fluid communication with the hydraulic fluid, which is in fluid communication with the master piston and valve piston. The position of the stroke limiter piston can be adjusted irrespective of engine RPM to provide varying lift and timing of the valve.

It is an object of the invention to provide in addition to a master piston operating via a camshaft, a variable camshaft that rotates independent of an engine rpm and of which controls the position of a stroke limiter piston to adjust the hydraulic pressure created by the master piston, and of which varies the lift of the valve.

A further object of the invention is to provide a variable camshaft that can be controlled independent of an engine rpm, but will rotate to adjust the stroke limiter piston in order to achieve optimal lift of the valve at predefined positions relative to engine rpm.

A further object of the invention is to provide a variable lift hydraulic valve train that can be modified to work with cylinders having two valves or four valves.

These together with additional objects, features and advantages of the variable lift hydraulic valve train will be readily apparent to those of ordinary skill in the art upon reading the following detailed description of presently preferred, but nonetheless illustrative, embodiments of the variable lift hydraulic valve train when taken in conjunction with the accompanying drawings.

In this respect, before explaining the current embodiments of the variable lift hydraulic valve train in detail, it is to be understood that the variable lift hydraulic valve train is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the variable lift hydraulic valve train.

It is therefore important that the claims be regarded as including such equivalent construction insofar as they do not depart from the spirit and scope of the variable lift hydraulic valve train. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
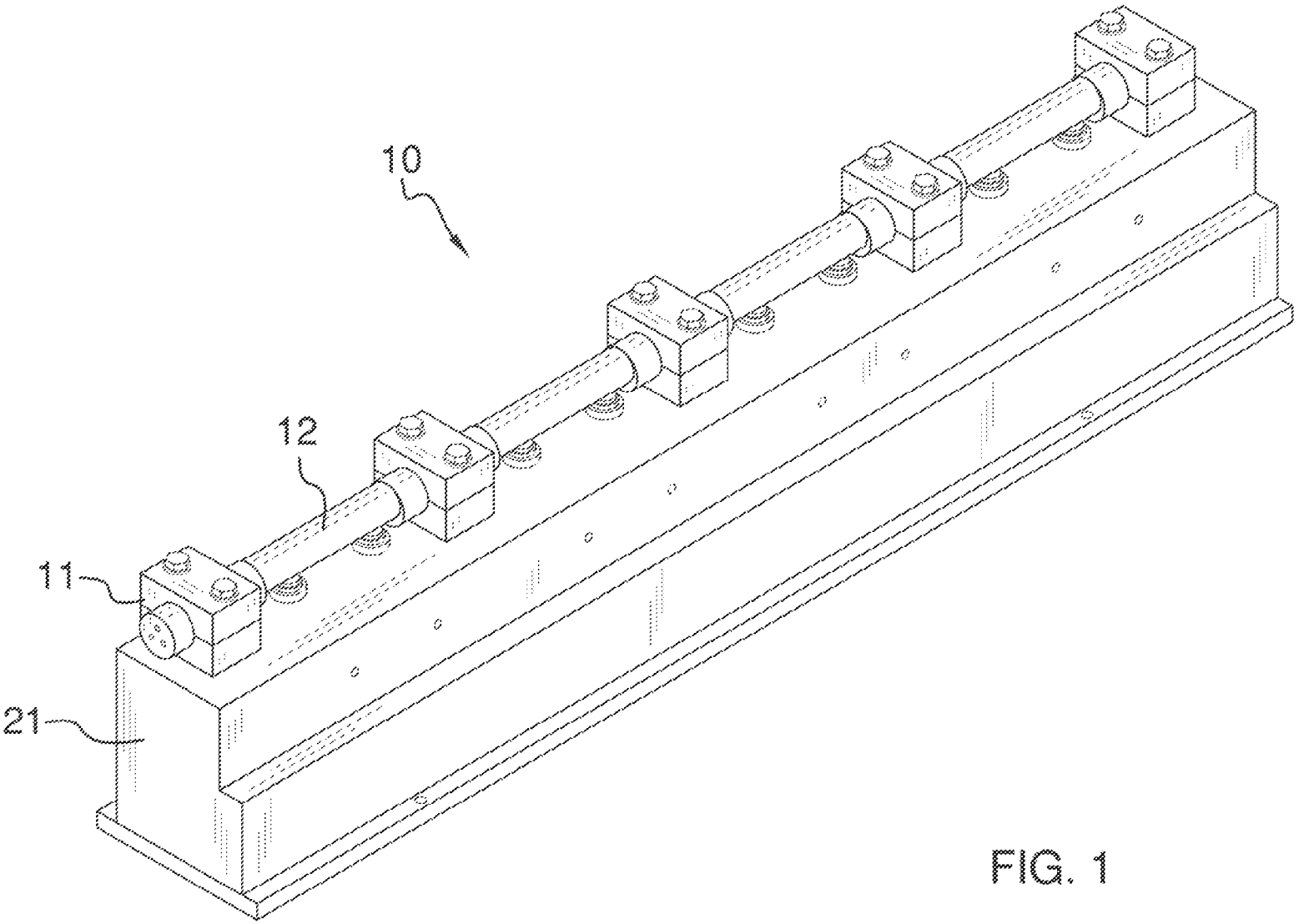
FIG. 1 illustrates a front, isometric view of the variable lift hydraulic valve train by itself.
Figure 2:
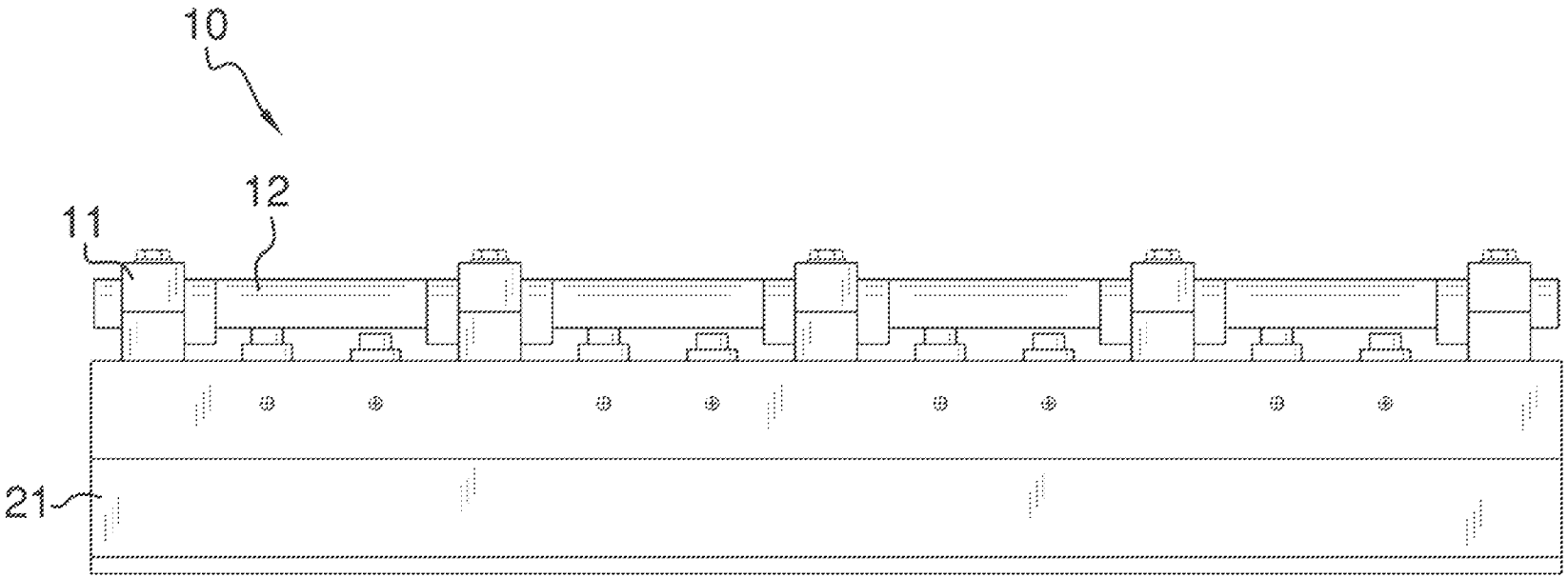
FIG. 2 illustrates a side view of the variable lift hydraulic valve train by itself.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4. A variable lift hydraulic valve train 10 (hereinafter invention) includes an upper housing 11, a variable camshaft 12, a stroke limiter piston 13, a bushing 14, a lower housing 21, a master piston 22, a camshaft 23, a check valve 24, a valve piston 31, a valve spring 32, and a valve 33.

The upper housing 11 is bolted onto the lower housing 21. The lower housing 21 is designed to be mounted onto an engine block 60. Standard operation of valve timing and lift is accomplished via movement of the camshaft 23 and the master piston 22, which is well known in the art.

It shall be noted that the variable camshaft 12, the stroke limiter piston 13, a stroke shaft 13B, and the brushing 14 are all separate parts that touch up against one another, and thus move together.

The stroke limiter piston 13 can move vertically within a limiter cylinder 11A, which is located in the upper housing 11. A collar 15 is located along an upper end of the limiter cylinder 11A and supports both the bushing 14 and the stroke limiter piston 13. A spring 16 is placed in between a bottom shoulder 15A of the collar 15 and a top surface 13A of the stroke limiter piston 13.

A second spring 16A is positioned between the stroke limiter piston 13 and the stroke shaft 13B such that a biasing force is imposed upon the stroke limiter piston 13 with respect to the stroke shaft 13B, and more importantly, the stroke limiter piston 13 is directed downwardly within the limiter cylinder 11A.

The second spring 16A imposes a biasing force in between the stroke limiter piston 13 and the stroke shaft 13B; whereas the spring 16 imposes a biasing force in between the stroke limiter shaft 13 and the collar 15.

As the variable camshaft 12 rotates, the position of the stroke limiter piston 13 adjusts within the limiter cylinder 11A. It shall be noted that the variable camshaft 12 only rotates when the RPMs of the engine 60 are changing. Thus, the angular velocity of the camshaft 12 is very small. The variable camshaft 12 rotates, to adjust the volume of space 11A' created between a bottom surface 13A of the stroke limiter piston 13 and the limiter cylinder 11A.

The space 11A' is in fluid communication with a master piston cylinder 21A. The master piston cylinder 21A accommodates vertical movement of the master piston 22. The master piston 22 moves up and down within the master piston cylinder 21A upon rotation of the camshaft 23. The camshaft 23 rotates in direct proportion to the rotational speed of a crankshaft 61. The camshaft 23 is mechanically linked to the crankshaft 61 via a timing belt (not shown), which is well known in the art.

The master piston cylinder 21A, the channel 21B, and the piston valve cylinder 21C are filled with a hydraulic fluid that maintains a charge pressure therein.

The crankshaft 61 is connected to pistons 62 via connecting rods 63. As the pistons 62 move up and down, the crankshaft 61 rotates thereby transmitting the up and down motion of the pistons 62 into a circular motion and power output of the engine 60.

Figure 3A:
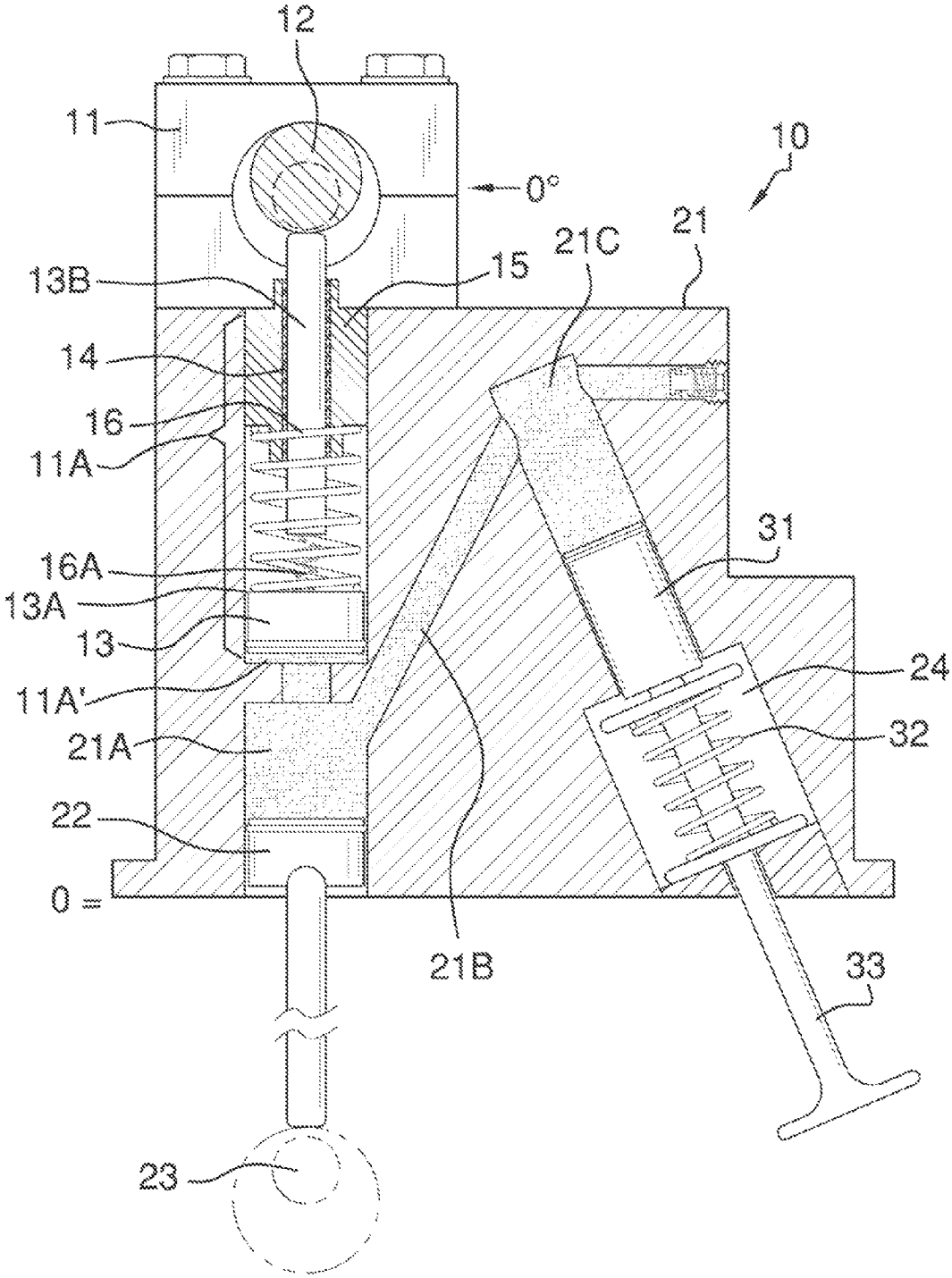
FIG. 3A illustrates a cross-sectional view of the variable lift hydraulic valve train installed upon an engine block wherein said engine block has all valves linearly aligned, and detailing the variable camshaft and stroke limiter position at a top position along with the master piston at a bottom position.

The master piston cylinder 21A is in fluid communication with both the limiter cylinder 11A and a channel 21B that is in fluid communication with a piston valve cylinder 21C. The piston valve cylinder 21C enables movement of the valve piston 31. The valve piston 31 is responsible for compression of the valve spring 32 and downward movement of the valve 33. The valve spring 32 is responsible for upward movement of the valve 33, once the valve piston 31 has returned to a top position as depicted in FIG. 3A.

The valve spring 32 is located within a spring cylinder 24 located within the lower housing 21. The valve piston 31 moves up and down within the piston valve cylinder 21C in direct response to the up and down movement of either the master piston 22 or the stroke limiter piston 13. In essence, the valve 33 is hydraulically operated, and adjusted in terms of lift distance 33'. The inventive feature of the invention 10 is the inclusion of the stroke limiter piston 13, and the ability to vary the position of the stroke limiter piston 13, which can effectively adjust the hydraulic pressure inside of the piston valve cylinder 21C thereby adjusting the lift and timing of the valve 33.

The lift and timing of the valve 33 are adjustable via the placement of the stroke limiter piston 13 of the invention 10.

Figure 3B:
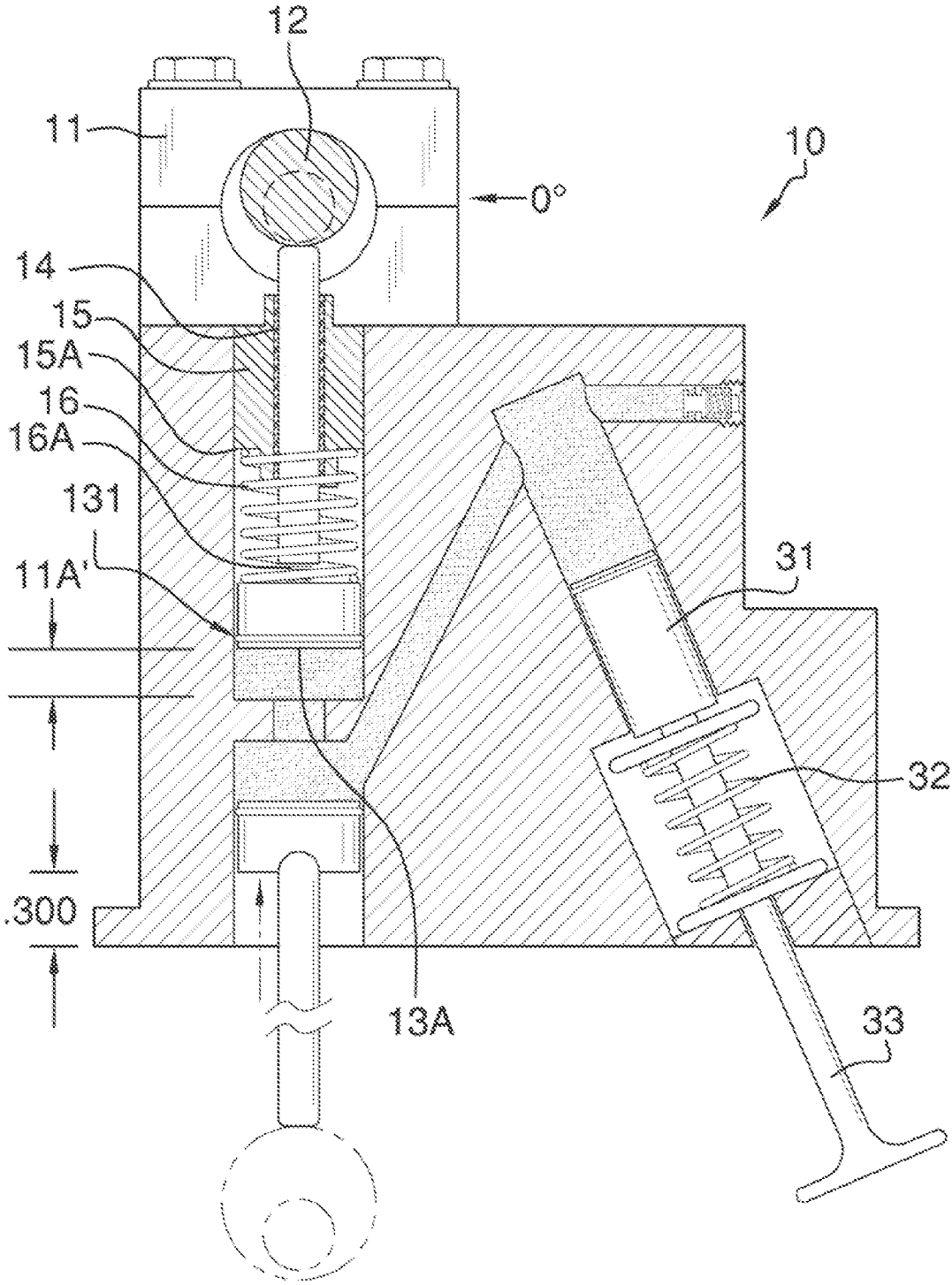
FIG. 3B illustrates a cross-sectional view of the variable lift hydraulic valve train detailing the variable camshaft and stroke limiter piston at a top position along with the master piston at a top position, and wherein defining the overall lift of the valve.
Figure 3C:
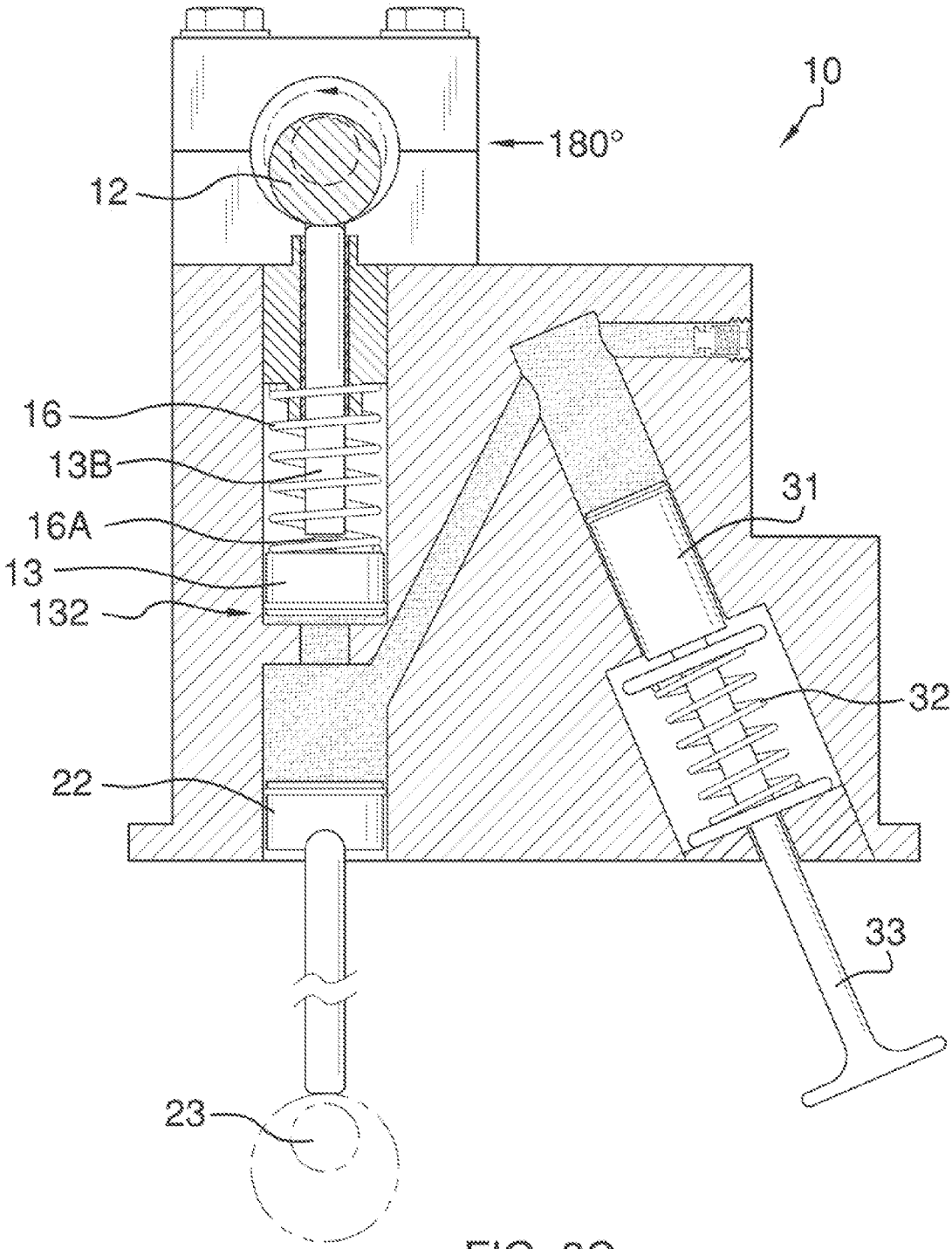
FIG. 3C illustrates a cross-sectional view of the variable lift hydraulic valve train detailing the variable camshaft and stroke limiter piston at a bottom position along with the master piston at a bottom position.
Figure 3D:
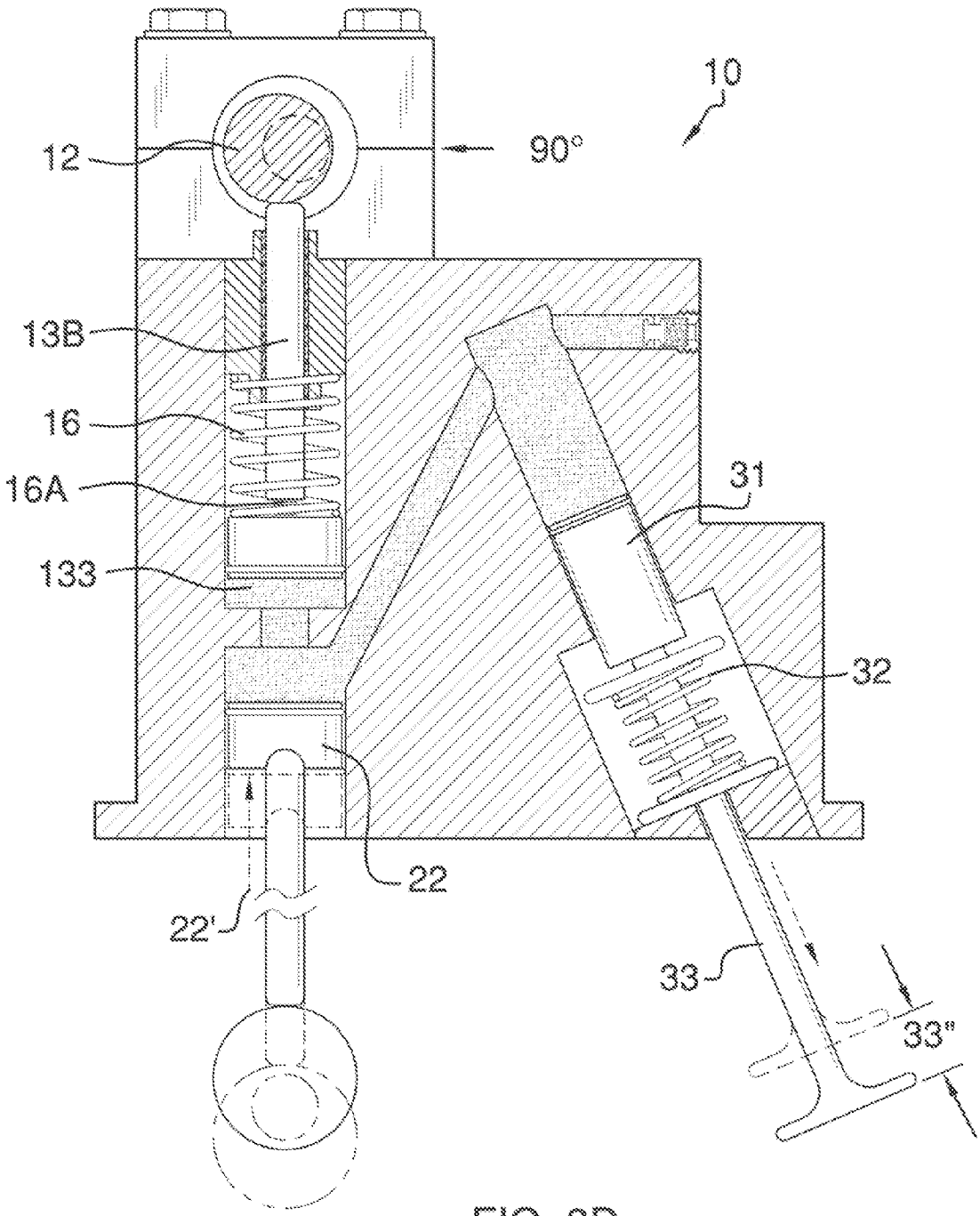
FIG. 3D illustrates a cross-sectional view of the variable lift hydraulic valve train detailing the variable camshaft and stroke limiter piston at a bottom position along with the master piston at a top position, and wherein defining the overall lift of the valve.
Figure 3E:
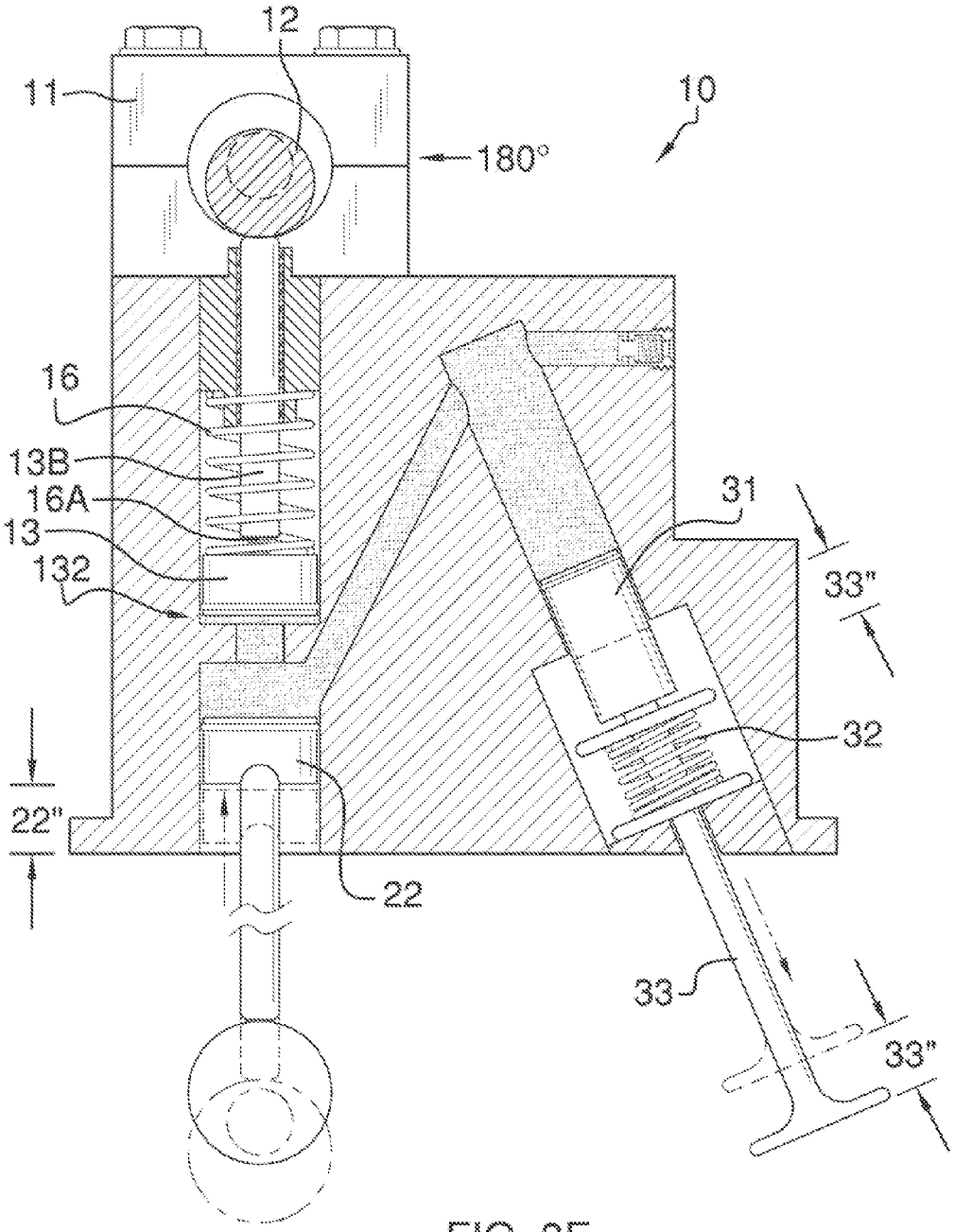
FIG. 3E illustrates a cross-sectional view of the variable lift hydraulic valve train detailing the camshaft with full lift of the master piston.
Figure 4:
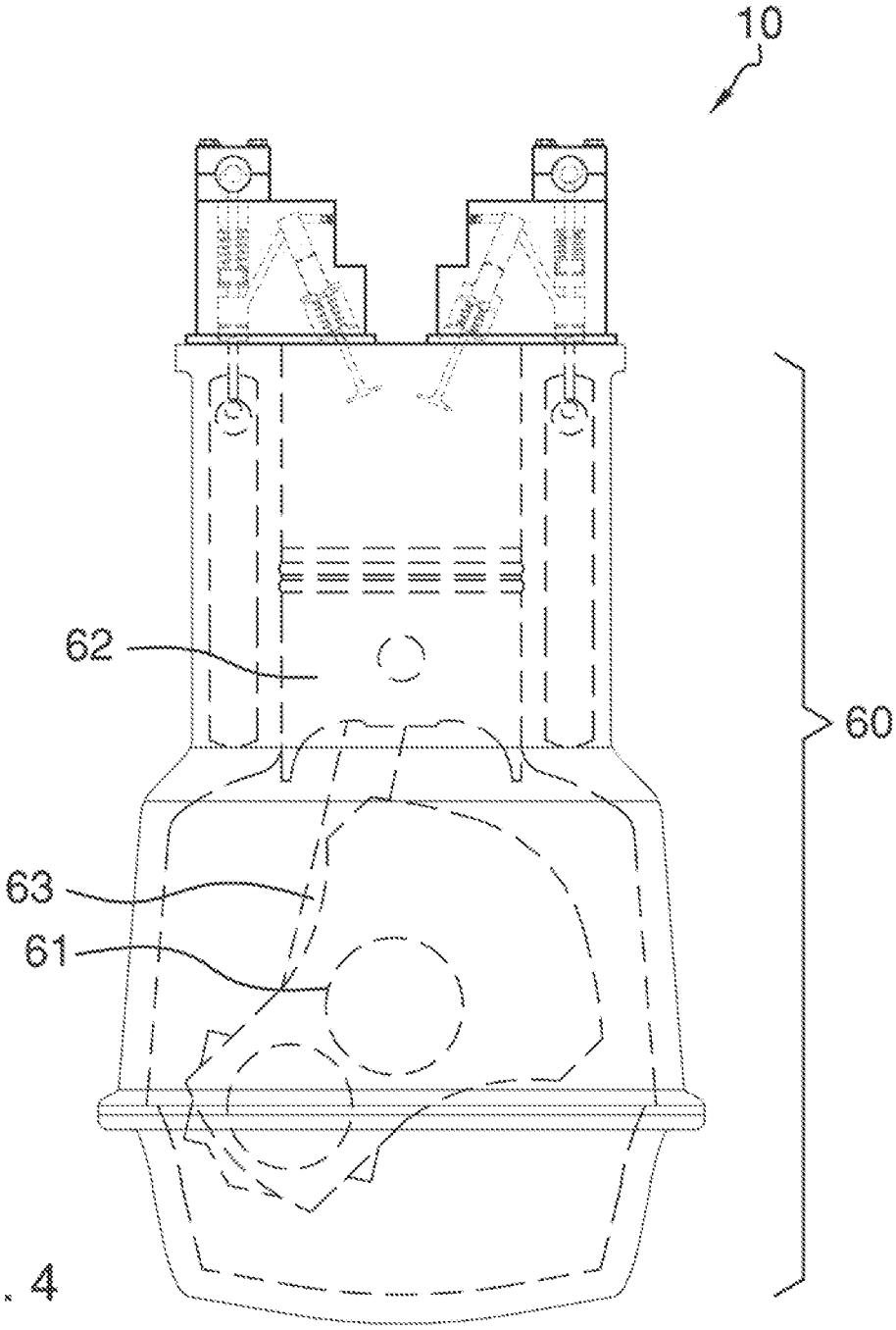
FIG. 4 illustrates a profile view of a single variable lift hydraulic valve train installed upon an engine block wherein the valves are linearly aligned.

Referring to FIG. 3B:

the stroke limiter piston 13 is at a top position 131;

the master piston 22 travels a master piston stroke 22';

both the valve piston 31 and the valve 33 travel a lift distance 33';

Referring to FIG. 3C:

the stroke limiter piston 13 is at a bottom position 132, which means that the volume of the space 11A' is the smallest;

the variable camshaft 12 has rotated 180 degrees to a position, which drives the stroke shaft 13B to a bottommost orientation;

the camshaft 23 has the master piston 22 at a bottom position;

Referring to FIG. 3D:

the stroke limiter piston 13 is at an intermediate position 133;

the variable camshaft 12 is rotated 90 degrees;

the master piston 22 travels a master piston stroke 22";

both the valve piston 31 and the valve 33 travel a lift distance 33";

it shall be noted that the lift distance 33" may be 0.300 inches;

Referring to FIG. 3E:

the stroke limiter piston 13 is at the bottom position 132;

the master piston 22 has traveled the master piston stroke 22";

the valve spring 32 has been fully compressed, and the valve 33 has traveled the lift distance 33";

It shall be noted that the stroke limiter piston 13 is at different positions 131, 132, and 133, which forms different volumes of the space 11A'. In fact, the space 11A' in FIG. 3B is greater than the space 11A' of FIG. 3D.

As the volume of the space 11A' increases, the lift distance 33" decreases. Coincidentally, as the volume of the space 11A' decreases, the lift distance 33" increases. Thus, the valve 33 is adjusted upon rotation of the variable camshaft 12.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A variable lift hydraulic valve train, further comprising:

a variable camshaft that upon rotation adjusts the location of a stroke limiter piston that is in fluid communication with a hydraulically operated valve;

wherein the variable camshaft rotates independent of an engine RPM, and adjusts the location of the stroke limiter piston to thereby adjust the lift of the hydraulically operated valve;

wherein a top housing supports the variable camshaft;

wherein the top housing is mounted atop a bottom housing, which includes the hydraulically operated valve;

wherein the hydraulically operated valve further comprises a master piston that moves up and down in mechanical connection with a camshaft; wherein a master piston cylinder contains hydraulic fluid that is in fluid communication with a stroke limiter cylinder containing the stroke limiter piston; wherein a channel is in fluid communication between the master piston cylinder and a valve piston cylinder containing a valve piston; wherein the valve is driven up and down via the valve piston and a spring.

2. The variable lift hydraulic valve train as described in claim 1 wherein the top housing and the bottom housing are mounted onto an engine block.

3. The variable lift hydraulic valve train as described in claim 2 wherein the variable camshaft, the stroke limiter piston, a stroke shaft, and a brushing are separate parts that touch up against one another.

4. The variable lift hydraulic valve train as described in claim 3 wherein the stroke limiter piston moves vertically within a limiter cylinder, which is located in the upper housing; wherein a collar is located along an upper end of the limiter cylinder and supports both the bushing and the stroke limiter piston; wherein a spring is placed in between a bottom shoulder of the collar and a top surface of the stroke limiter piston.

5. The variable lift hydraulic valve train as described in claim 4 wherein a second spring is positioned between the stroke limiter piston and the stroke shaft such that a biasing force is imposed upon the stroke limiter piston with respect to the stroke shaft.

6. The variable lift hydraulic valve train as described in claim 5 wherein the variable camshaft rotates, to adjust the volume of space created between a bottom surface of the stroke limiter piston and a limiter cylinder.

7. The variable lift hydraulic valve train as described in claim 6 wherein the space is in fluid communication with the master piston cylinder.

8. A variable lift hydraulic valve train, further comprising:

a variable camshaft that upon rotation adjusts the location of a stroke limiter piston that is in fluid communication with a hydraulically operated valve;

wherein the variable camshaft rotates independent of an engine RPM, and adjusts the location of the stroke limiter piston to thereby adjust the lift of the hydraulically operated valve;

wherein a top housing supports the variable camshaft;

wherein the top housing and a bottom housing are mounted onto an engine block;

wherein the variable camshaft, the stroke limiter piston, a stroke shaft, and a brushing are separate parts that touch up against one another;

wherein the stroke limiter piston moves vertically within a limiter cylinder, which is located in the upper housing; wherein a collar is located along an upper end of the limiter cylinder and supports both the bushing and the stroke limiter piston; wherein a spring is placed in between a bottom shoulder of the collar and a top surface of the stroke limiter piston.

9. The variable lift hydraulic valve train as described in claim 8 wherein the top housing is mounted atop the bottom housing, which includes the hydraulically operated valve.

10. The variable lift hydraulic valve train as described in claim 9 wherein the hydraulically operated valve further comprises a master piston that moves up and down in mechanical connection with a camshaft; wherein a master piston cylinder contains hydraulic fluid that is in fluid communication with a stroke limiter cylinder containing the stroke limiter piston; wherein a channel is in fluid communication between the master piston cylinder and a valve piston cylinder containing a valve piston; wherein the valve is driven up and down via the valve piston and a spring.

11. The variable lift hydraulic valve train as described in claim 10 wherein a second spring is positioned between the stroke limiter piston and the stroke shaft such that a biasing force is imposed upon the stroke limiter piston with respect to the stroke shaft.

12. The variable lift hydraulic valve train as described in claim 11 wherein the variable camshaft rotates, to adjust the volume of space created between a bottom surface of the stroke limiter piston and a limiter cylinder.

13. The variable lift hydraulic valve train as described in claim 12 wherein the space is in fluid communication with the master piston cylinder.

* * * * *